US010569153B2

(12) United States Patent
Hemara

(10) Patent No.: US 10,569,153 B2
(45) Date of Patent: Feb. 25, 2020

(54) PROTECTIVE SPORTS ACCESSORY

(71) Applicant: Apirana Hemara, Runaway Bay (AU)

(72) Inventor: Apirana Hemara, Runaway Bay (AU)

( * ) Notice: Subject to any disclaimer, the term of this patent is extended or adjusted under 35 U.S.C. 154(b) by 555 days.

(21) Appl. No.: 15/387,556

(22) Filed: Dec. 21, 2016

(65) Prior Publication Data

US 2017/0173442 A1 Jun. 22, 2017

(30) Foreign Application Priority Data

Dec. 21, 2015 (AU) ..... 2015905294

(51) Int. Cl.
*A63B 71/14* (2006.01)

(52) U.S. Cl.
CPC ..... *A63B 71/14* (2013.01)

(58) Field of Classification Search
CPC .. A63B 2209/10; A63B 2244/10; A63B 71/14
See application file for complete search history.

(56) References Cited

U.S. PATENT DOCUMENTS

| | | | | |
|---|---|---|---|---|
| 3,994,025 | A | 11/1976 | Petroski | |
| 4,417,359 | A | 11/1983 | Johnson | |
| 4,864,660 | A | 9/1989 | Sawyer | |
| 5,295,269 | A | 3/1994 | Ballard | |
| 5,575,008 | A | 11/1996 | McBride et al. | |
| 5,802,614 | A | 9/1998 | Melone | |
| 6,013,044 | A | 1/2000 | Estwanik | |
| 6,093,165 | A | 7/2000 | Estwanik | |
| 6,691,315 | B1 | 2/2004 | Clarke et al. | |
| 6,711,747 | B2 | 3/2004 | Carlin | |
| 6,757,915 | B2 * | 7/2004 | Sidlo | A63B 71/14 2/16 |
| 7,278,980 | B1 | 10/2007 | Garelick et al. | |
| 7,402,149 | B1 | 7/2008 | Garelick et al. | |
| 7,442,177 | B1 | 10/2008 | Garelick et al. | |
| 7,455,650 | B1 | 11/2008 | Garelick et al. | |
| 7,475,433 | B2 | 1/2009 | Coulter et al. | |
| 8,474,063 | B2 | 7/2013 | Coulter et al. | |
| 8,646,113 | B2 | 2/2014 | Clement et al. | |
| D732,747 | S | 6/2015 | Phillips et al. | |
| 9,480,902 | B2 | 11/2016 | House | |
| 2005/0267391 | A1 | 12/2005 | Garelick et al. | |
| 2012/0210485 | A1 | 8/2012 | Clement et al. | |
| 2013/0014306 | A1 | 1/2013 | Mechling et al. | |
| 2013/0198920 | A1 | 8/2013 | Wittman | |
| 2015/0143600 | A1 | 5/2015 | House | |
| 2016/0051883 | A1 | 2/2016 | Clement et al. | |

* cited by examiner

*Primary Examiner* — Anna K Kinsaul
(74) *Attorney, Agent, or Firm* — FisherBroyles, LLP; Ariel Reinitz

(57) ABSTRACT

A protective sports accessory for protecting a hand of a user when striking includes a wrist wrap configured for strapping around a wrist of the user. A finger grip is configured for gripping with fingers when the hand is formed into a fist. A tensioning member interconnects the wrist wrap and the finger grip, the wrist wrap, the finger grip and the tensioning member being configured for setting up tension in the tensioning member when the hand is formed into the fist.

13 Claims, 6 Drawing Sheets

PROTECTIVE SPORTS ACCESSORY

FIELD OF THE INVENTION

Various embodiments of a protective sports accessory for protecting a hand of a user are described herein.

RELATED APPLICATIONS

The present application claims the benefit of Australian provisional patent application 2015905294, filed 21 Dec. 2015, the contents of which are herein incorporated by reference.

SUMMARY OF THE INVENTION

In one aspect there is provided a protective sports accessory for protecting a hand of a user when striking that comprises:

a wrist wrap configured for strapping around a wrist of the user;

a finger grip configured for gripping with fingers when the hand is formed into a fist; and a tensioning member that interconnects the wrist wrap and the finger grip, the wrist wrap, the finger grip and the tensioning member being configured for setting up tension in the tensioning member when the hand is formed into the fist.

The finger grip may include an elongated grip strap configured for wrapping about knuckles of the user and having an elongated intermediate grip portion configured for being gripped with fingers when forming the fist and retained at about a junction between the fingers and the palm.

The tensioning member may interconnect the intermediate grip portion and the wrist wrap.

The grip strap may include two end portions, the intermediate grip portion being interposed between the end portions and the end portions being wider than the intermediate grip portion.

A securing arrangement may be arranged on each end portion so that the end portions can be secured to each other, the intermediate grip portion and the end portions being configured so that the end portions can be secured to each other over the knuckles.

One of the end portions may include a threading aperture so that the intermediate grip portion is threaded through the aperture to define a loop through which the fingers can extend.

The grip portion may be dimensioned so that the grip portion can be doubled back, over the loop, to allow the end portions to be secured to each other over the knuckles.

The securing arrangement may include part of a fastener on an obverse surface of one of the end portions and a complementary part of the fastener on an obverse surface of the other of the end portions so that one of the end portions can overlie the other and both end portions can overlie the knuckles.

The tensioning member may include at least one tensioning strap that is connected, at one end, to the wrist wrap and, at an opposite end, to the intermediate portion, to extend across the loop so that, together with the intermediate portion, the loop is divided into at least two openings, each opening accommodating at least one finger.

The, or each, tensioning strap may be configured to extend between one of the end portions that overlies the knuckles and the knuckles and between the fingers.

At least one sleeve may be arranged on a reverse surface of the one of the end portions so that the, or each, tensioning strap is received through one respective sleeve and can slide relative to the sleeve to accommodate the setting up of tension in the, or each, tensioning strap when the fist is formed.

The, or each, tensioning strap has a loop at its end with the intermediate portion received through the loop, the loop being capable of sliding relative to the intermediate portion so that the openings can accommodate differently sized fingers.

The tensioning member may include three tensioning straps so that the loop is divided into four openings, one for each finger.

The wrist wrap may include elongated wrist strap portions that have a securing arrangement for wrapping around a wrist of the user and for securing the wrist strap in position when wrapped around the wrist of the user.

A thumb strap may be connected to the wrist strap at one end and a thumb loop is arranged at an opposite end of the wrist strap, the thumb loop being configured to receive a thumb of the user and the thumb strap being configured to extend over the back of the hand and dimensioned so that a tension is set up in the thumb strap when the fist is formed for striking.

In one aspect there is provided a protective sports accessory for protecting a hand and wrist of a user when punching that comprises:

a wrist strap for strapping around a wrist of the user;

a knuckle strap for strapping around knuckles of the user and capable of being gripped with fingers doubled into a palm when forming a fist, the knuckle strap having an intermediate grip portion that can extend across an inside of the hand so that, when tightened, the knuckle strap is capable of urging the knuckles together; and a number of tensioning straps that interconnect the wrist strap and the intermediate grip portion to define, together with the knuckle strap, openings through which fingers can be received.

The tensioning straps may be arranged on the knuckle strap in an adjustable manner so that a size of the openings adjust to suit the user when fingers are inserted through the openings.

In one aspect there is provided a protective sports accessory for protecting a hand and wrist of a user when punching that comprises:

a wrist strap for strapping around a wrist of the user;

a knuckle strap for strapping around knuckles of the user and capable of being gripped with fingers doubled into a palm when forming a fist, the knuckle strap having an inner portion for extending across an inside of the hand and an outer portion for extending across a back of the hand so that, when tightened, the knuckle strap is capable of urging the knuckles together;

a number of finger tabs that interconnect the inner and outer portions to define, together with the knuckle strap, openings through which respective fingers can be received; and a connector that interconnects the wrist wrap and the knuckle strap.

The finger tabs may be arranged on the at least one of the inner and outer portions in an adjustable manner so that a size of the openings adjust to suit the user when fingers are inserted through the openings.

In one aspect there is provided a protective sports accessory for protecting a hand and wrist of a user when punching that comprises:

a knuckle strap for strapping around knuckles of the user and capable of being gripped with fingers doubled into a palm when forming a fist, the knuckle strap having an inner portion for extending across an inside of the hand and an outer portion for extending across a back of the hand so that, when tightened, the knuckle strap is capable of urging the knuckles together; and a number of finger tabs that interconnect the inner and outer portions to define, together with the knuckle strap, openings through which respective fingers can be received.

DESCRIPTION OF THE DRAWINGS

FIG. 8 shows a template for forming a finger grip of the accessory in FIG. 1.

FIG. 9 shows a top or upper side of the completed finger grip when formed with the template of FIG. 8.

FIG. 10 shows a bottom or underside of the completed finger grip when formed with the template of FIG. 8.

FIG. 11 shows tensioning members of the accessory of FIG. 1.

DESCRIPTION OF EMBODIMENTS

Figure 1:
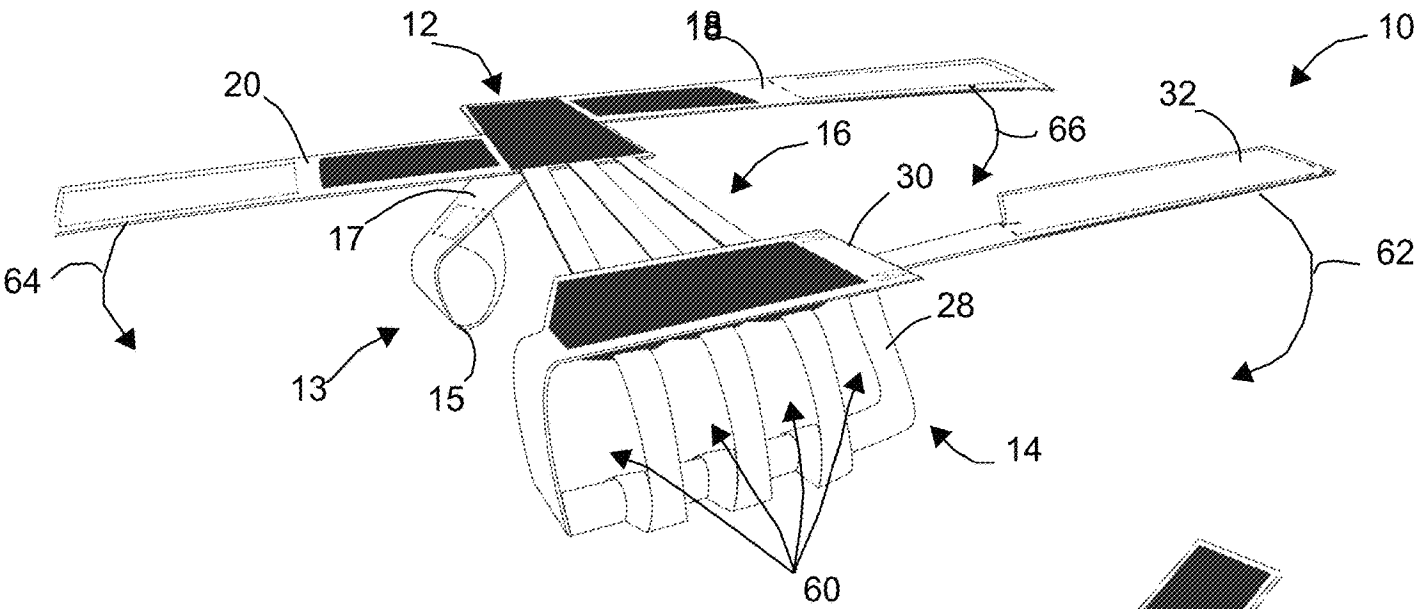
FIG. 1 shows a diagrammatic drawing of a protective sports accessory, in three-dimensional view seen from above, for protecting a hand of a user when forming a fist for striking that is partially folded for use.
Figure 2:
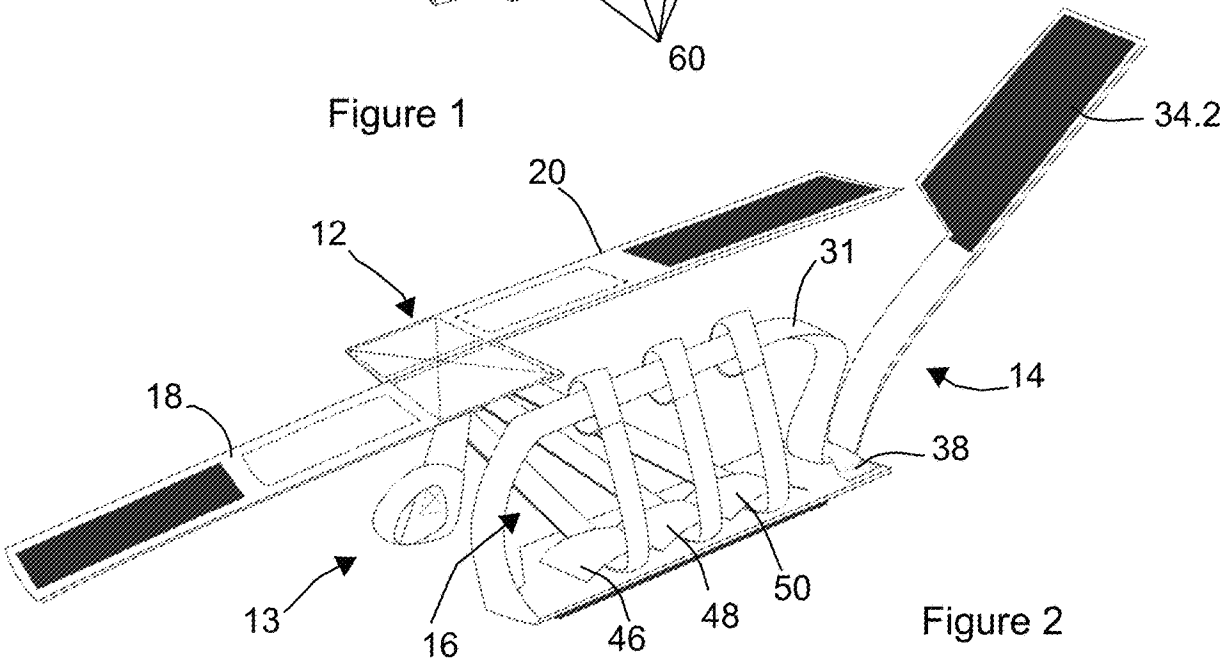
FIG. 2 shows a diagrammatic drawing of the protective sports accessory in FIG. 1, in three-dimensional view seen from below.

In the drawings, reference numeral 10 generally refers to an embodiment of a protective sports accessory for protecting a hand 11 (FIGS. 5 to 7) of a user when striking.

Broadly, the sports accessory 10 includes a wrist wrap or strap, generally indicated by reference numeral 12, which can fit snugly around a wrist of the user, when strapped to the wrist, and a finger grip, generally indicated by reference numeral 14, which is capable of being gripped with fingers 23 when forming the fist. The sports accessory 10 further includes a connector or tensioning member, generally indicated by reference numeral 16, which extends between and interconnects the wrist wrap 12 and the finger grip 14. In use, the tensioning member 16 extends substantially taut over a back 21 of the hand, so that, when the fist is formed a tension is set up in the tensioning member 16 in a manner that facilitates stabilization of at least carpal and metacarpal bones of the hand. This can protect those bones from damage, which can result from repetitive punching, for example.

The fact that the finger grip 14 is connected to the wrist wrap 12 via the tensioning member 16 results in the finger grip 14 being retained in a position in which a palm 19 of the hand 11 is kept substantially free of straps and other items. In other words, the tensioning member 16 serves to pull the finger grip 14 into a junction of the fingers 23 and the palm 19 when the hand 11 is balled into a fist. See, for example, FIG. 7. Thus, when, for example, a mixed martial arts glove is worn over the accessory 10, the wearer can grapple with an opponent without hindrance by such straps and other items.

Figure 3:
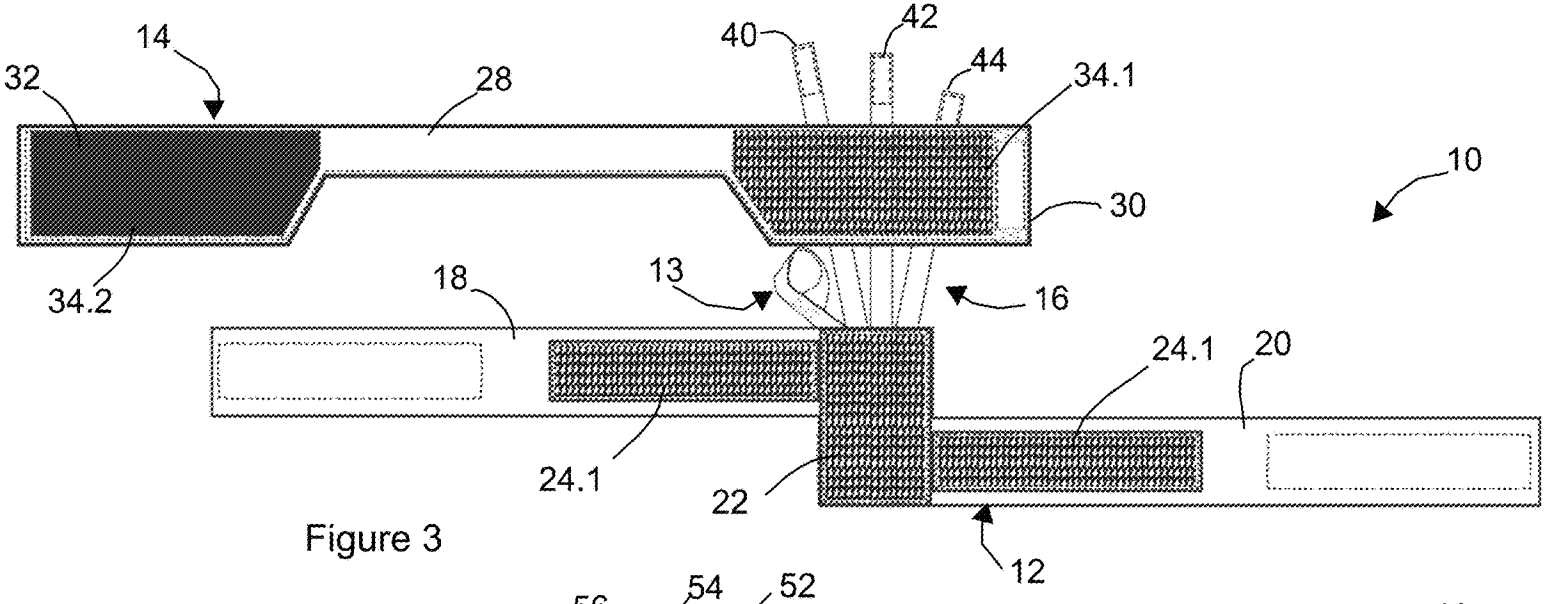
FIG. 3 shows a diagrammatic drawing of the protective sports accessory in top plan view when unfolded or partly disassembled.

The wrist wrap 12 includes one elongated rectangular wrist strap portion 18 and another elongated rectangular wrist strap portion 20 that extend away from each other at relatively offset positions from a rectangular central wrist strap portion 22 (FIG. 3). The portions 18, 20 and 22 are of cotton twill fabric. Other materials may be suitable, however. Instead, the wrist wrap 12 can have just one elongated portion that can wrap about the wrist in a conventional fashion to be fastened to itself.

Figure 4:
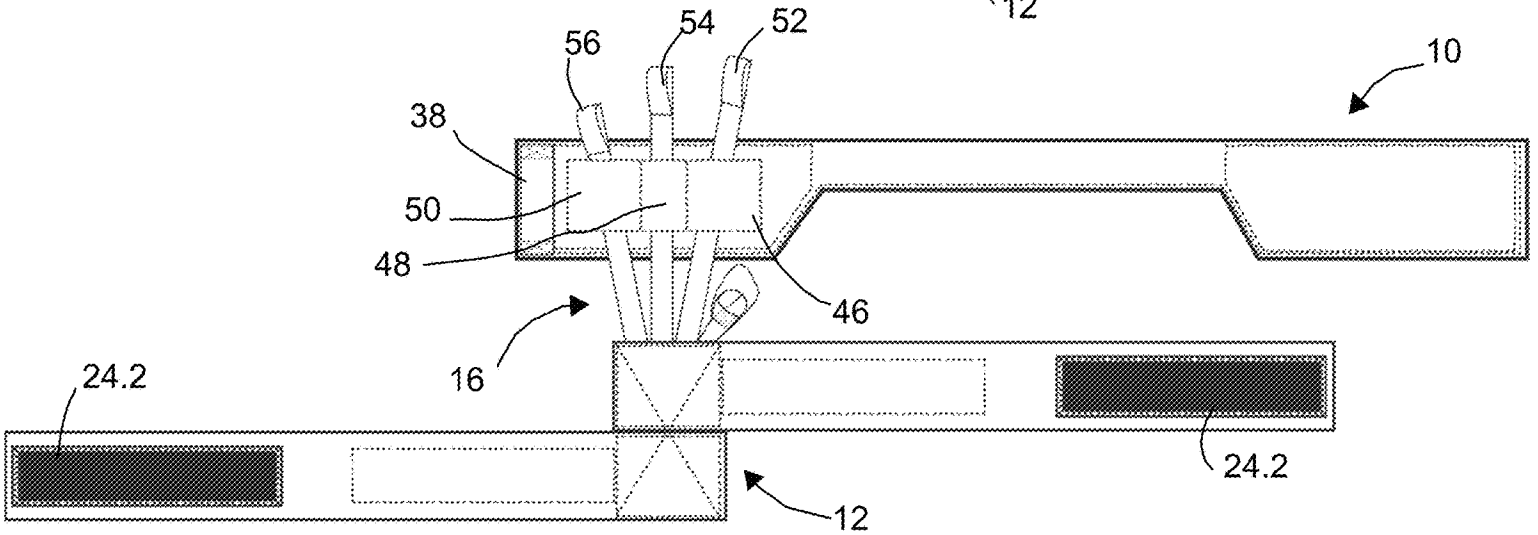
FIG. 4 shows a diagrammatic drawing of the protective sports accessory in FIG. 3 in bottom plan view.

As can be seen in FIGS. 3 and 4, the wrist wrap 12 includes a securing arrangement in the form of a hook and loop fastener having one part 24.1 fastened to, and overlying an obverse surface of the central wrist strap portion 22 and part of the wrist strap portions 18 and 20 adjacent the central wrist strap portion 22. The other part 24.2 of the hook and loop fastener is fastened to and overlays part of a reverse surface of the free end portions of the wrist strap portions 18 and 20.

The finger grip 14 is in the form of an elongated grip strap or knuckle strap having an elongated rectangular intermediate grip portion 28 and two relatively wider grip strap end portions 30 and 32. The grip strap 14 is configured so that it can be wrapped around the knuckles 27 of a user (FIG. 7), with the elongated grip portion 28 being configured for gripping with the fingers 23 when forming the fist and retained at about a junction between the fingers and the palm. The grip strap 14 also includes a securing arrangement in the form of one part of a fastener, such as a hook and loop fastener in which one part 34.1 of the hook and loop fastener overlies an obverse surface of the one wider grip strap end portion 30 and a complementary part of the fastener, such as the other part 34.2 of the hook and loop fastener, overlies an obverse surface of the other wider grip strap end portion 32.

Further, the grip strap 14 includes a threading aperture or eye in the form of a tab 38 adjacent an end of the wider grip strap end portion 30. The intermediate grip portion 28 is threaded through the tab 38 to form a loop 31 through which the fingers 23 can extend. The grip portion 28 is dimensioned so that it can then be doubled back, over the loop 31, so that the portion 32 can be secured to the portion 30, over the knuckles 27. Instead of the tab 28, an eye can be formed in the end portion 30. It will be appreciated that the user can pull on the end portion 32 to tighten the grip strap 14 onto the knuckles 27 before doubling the portion 28 back over the loop 31. This can facilitate stabilization of the carpal and metacarpal bones of the fingers 23.

The tensioning member 16 includes three tensioning straps 40, 42, and 44 (FIG. 3), that are attached with their one ends adjacent each other to the central wrist strap portion 22. The straps 40, 42 and 44 are attached at their other ends to the intermediate grip portion 28 so that the tensioning member 16 serves to interconnect the intermediate grip portion and the wrist wrap 12. The tensioning straps 40, 42, and 44 extend from the central wrist strap portion 22 through respective adjacent sleeves 46, 48, and 50 that are provided underneath the wider grip strap end portion 30, on the reverse side. The sleeves 46 to 50 are dimensioned to permit the straps to slide relative to the sleeves to accommodate tensioning of the straps as the fist is formed. Thus, the tensioning straps 46, 48 and 50 extend between the knuckles 27 and the portion 30. The tension set up in the straps can be as a result of the change in shape of the hand as it is formed into a fist. The tensioning straps 40, 42 and 44 extend across the loop 31 to define four openings 60 together with the grip portion 28 to accommodate respective fingers 23. It will be appreciated that one or two tensioning straps could also be provided. The tension thus serves to retain the grip portion 28 in the junction between the fingers 23 and the palm 19 to keep the palm 19 clear. This serves to obviate any interference by the accessory 10 with hand manipulation required for grappling.

The tensioning straps 40, 42, and 44 include end loops 52, 54, and 56, at their free ends, respectively.

The sports accessory 10 includes a thumb strap 13. The thumb strap 13 includes a thumb loop 15 to accommodate a thumb 25 of the user. The thumb loop 15 is connected to the wrist wrap 12 with a tab 17. The tab 17 is dimensioned so that, as the hand 11 is balled into a fist, a tension is set up in the tab 17, further to stabilize the thumb 25 and at least the carpal and metacarpal bones and joints of the thumb 25. Furthermore, the tab 17 is configured to overlie the back 21 of the hand also to maintain the palm 19 substantially free of straps and other components.

Generally, the wrist wrap 12, grip strap 14, tensioning straps 16, sleeves 46, 48, and 50 and thumb strap 13 are formed from a flexible textile material, such as cotton twill fabric, that is shaped and stitched together to form the sports accessory 10, as described further below.

In use, the sports accessory 10 is fitted to the hand 11 of a user by lacing the wider grip strap end portion 32 through the end loops 52, 54, 56 of the tensioning straps 40, 42, 44, and through the rectangular eye 38 to form the configuration as shown for example in FIG. 1.

Figure 5:
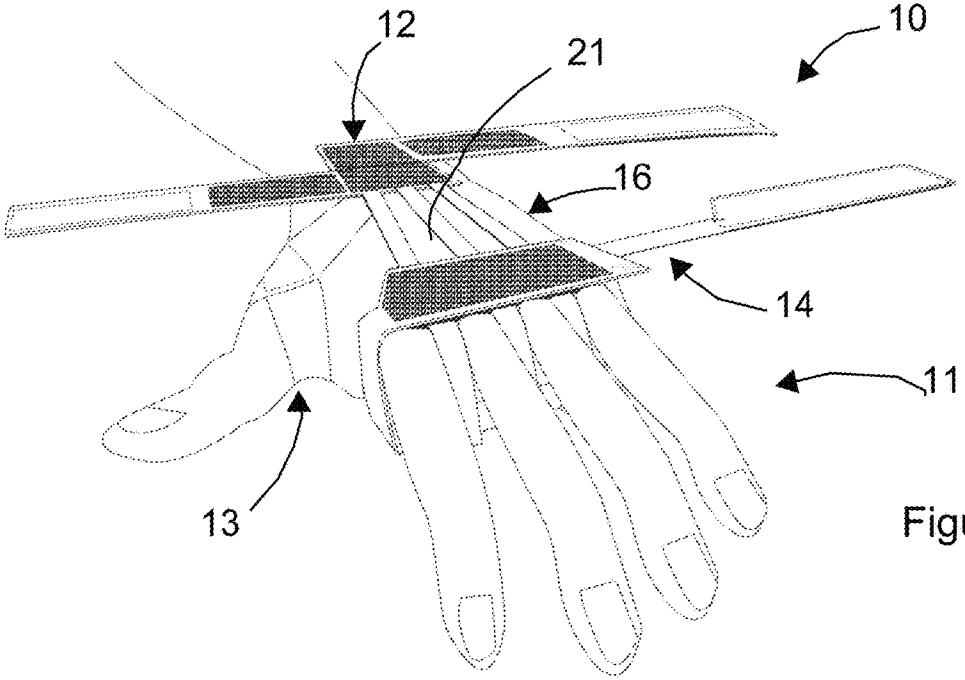
FIG. 5 shows a diagrammatic drawing, from above, of the protective sports accessory in FIG. 1, partially fitted on a hand of a user.
Figure 6:
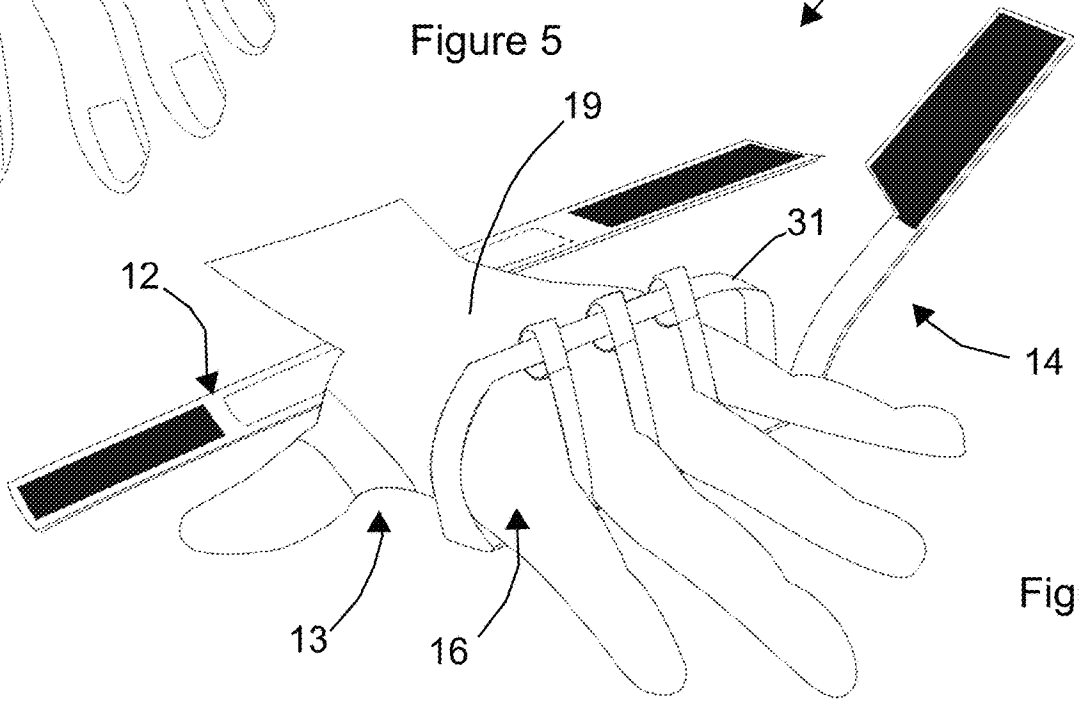
FIG. 6 shows a diagrammatic drawing, from below, of the protective sports accessory in FIG. 2, partially fitted on a hand of a user.

When the sports accessory 10 is configured as shown in FIG. 1, the accessory 10 has finger tabs that define the four adjacent openings 60 through which fingers of the hand pass as shown in FIG. 5 with the wider grip strap end portion 30 covering the knuckles of the hand. The grip strap 14 can then be pulled and tightened around the hand and the grip strap 14 doubled back onto itself (see arrow 62) around the hand so that the wider grip strap end portions 30 and 32 attach to each other with the hook and loop fasteners 34, 36 and overlie each other, as shown in FIG. 7.

Figure 7:
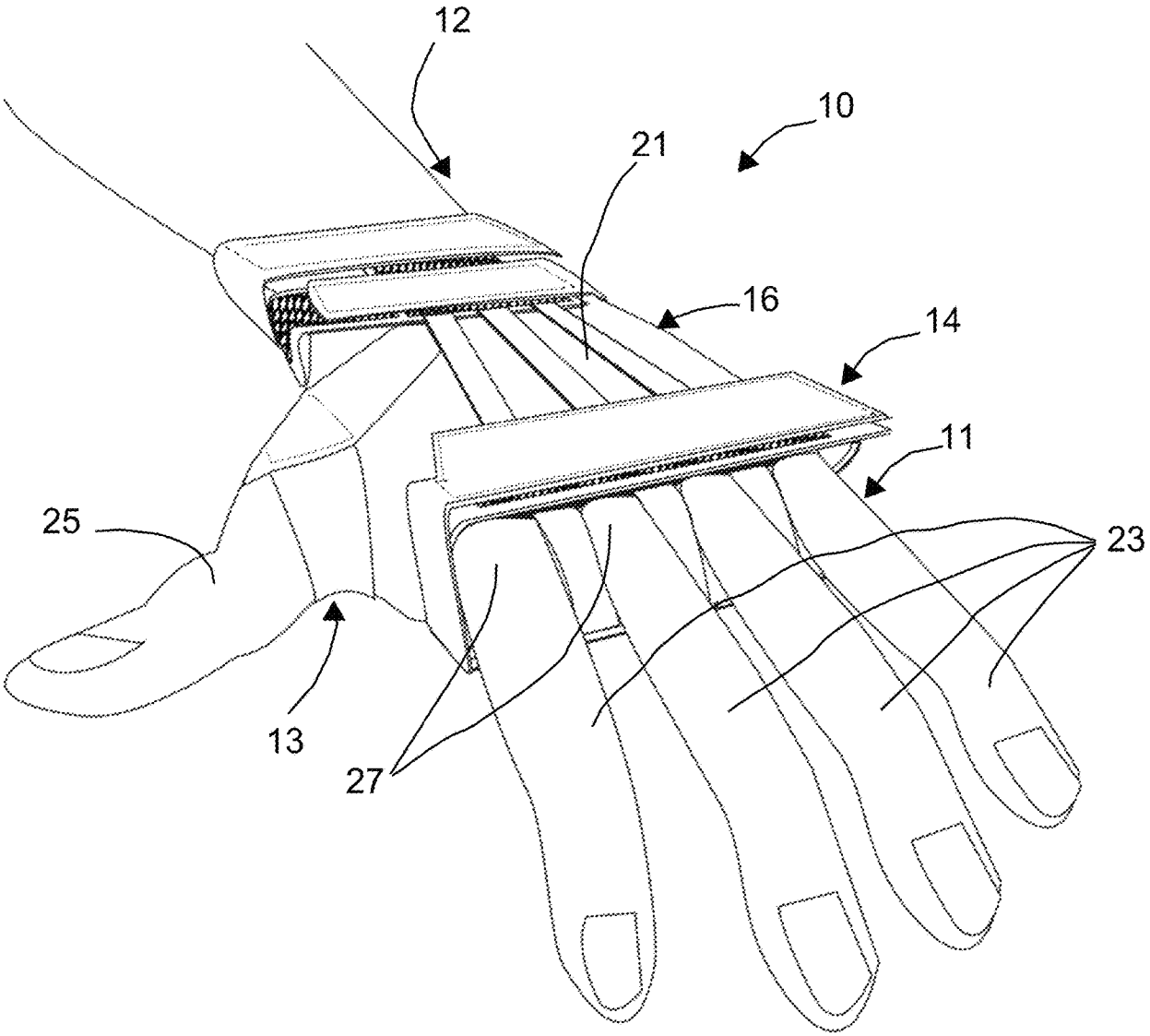
FIG. 7 shows a diagrammatic drawing, from above, of the protective sports accessory in the above Figures, in use, fitted to a hand of user.
Figure 12:
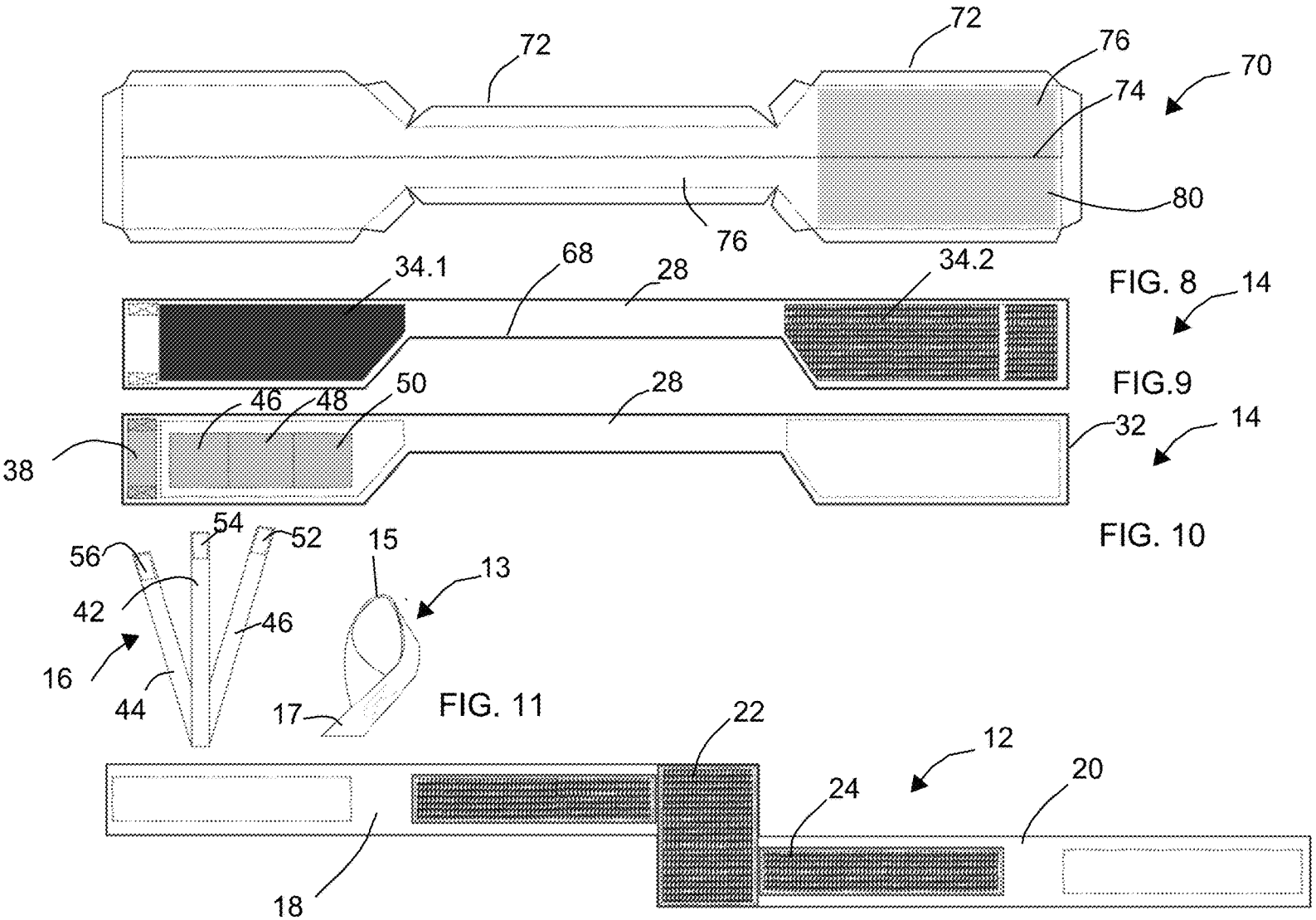
FIG. 12 shows a wrist strap of the accessory of FIG. 1.

The wrist strap portions 18 and 20 are then folded, see arrows 64 and 66, to wrap around the wrist and secured in position with the hook and loop fasteners 24, 26 as shown in FIG. 7.

When the intermediate grip portion 28 is laced through the end loops 52, 54, 56 of the tensioning straps 40, 42, 44, then those end loops 52, 54, 56 can slide along the intermediate grip portion 28. Also, the sleeves 46, 48, and 50 are such that their through passages provide some play for the tensioning straps 40, 42, 44, when passed through the sleeves 46, 48, and 50 which allow for some lateral movement of the tensioning straps 40, 42, 44 inside the sleeves. It follows that the tensioning straps 40, 42, 44 can move relative to each other which enables the tensioning straps 40, 42, 44 to settle between fingers of a hand so as to conform to the spacing between fingers, so being adjustable to accommodate differently sized fingers.

The tensioning straps 40, 42, 44 have lengths that cause the tensioning straps 40, 42, 44 to be substantially taut over the backside of the hand. Thus, when the fist is formed, the relative displacement of the intermediate grip strap 14 and the wrist wrap 12 causes the tensioning straps 40, 42, 44 to tension. This facilitates stabilization of at least carpal and metacarpal bones. The tension can result in the metacarpal bones being urged towards the carpal bones to provide a protective effect to those bones and the soft tissue associated with those bones. This can reduce the risk of injury to the hand when striking, for example striking with the hand formed as a fist. This also serves to reduce the risk of injury as a result of repetitive striking or punching, for example when the user is training with a boxing bag.

The sports accessory 10 is also useful in having a wrist wrap 12 that wraps around the wrist and that reduces the risk of injury to the wrist when striking with the hand formed as a fist.

Further, the grip strap 14, in particular the wide grip strap end portions 30, 34, fit over knuckles of the hand, and that can also reduce the risk of injury to the metacarpal bones, the knuckles and the phalanges when striking with the hand formed as a fist. When the grip or knuckle strap 14 is wrapped around the knuckles, the grip strap 14 can serve to stabilize the metacarpal bones, the phalanges and the soft tissue associated with those bones.

In FIG. 8, reference numeral 70 generally indicates a template that is used for the fabrication of the grip strap or knuckle strap 14. As such, the template 70 is cut as shown in FIG. 8 so that it defines tabs 72 that are folded inwardly and stitched to reinforce the edges of the template 70 before the template 70 is folded over a fold line 74 to form the knuckle strap 14, as shown in FIGS. 9 and 10.

Thus, the template 70 has two substantially identical halves 76 that are stitched together along lines 78. Prior to folding the halves 76 together, a batting material can be positioned in an area indicated by reference numeral 80 to provide extra padding for the knuckles. The batting material can be a polyester fabric.

The sleeves 46, 48 and 50 are defined by a strip of material that is stitched onto the portion 30. The strip of material can be of a cotton drill material, for example.

The tensioning straps 40, 42, 44 can be of a number of suitable materials, one of which can be a cotton drill material. Free ends of the straps 40, 42, 44 can be folded over and stitched to form the end loops 52, 54, 56.

Figure 14:
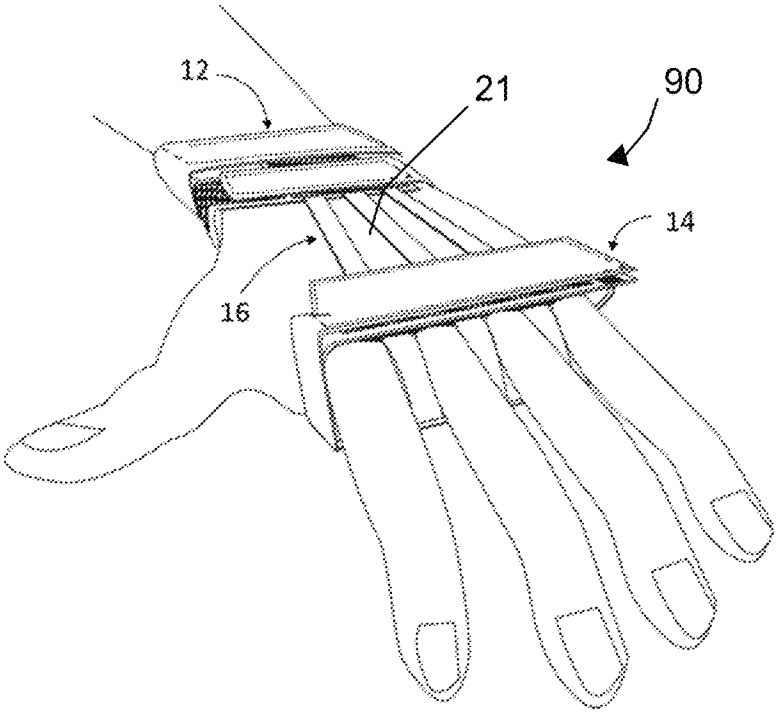
FIG. 14 shows a diagrammatic drawing, from above, of the accessory of FIG. 13.
Figure 13:
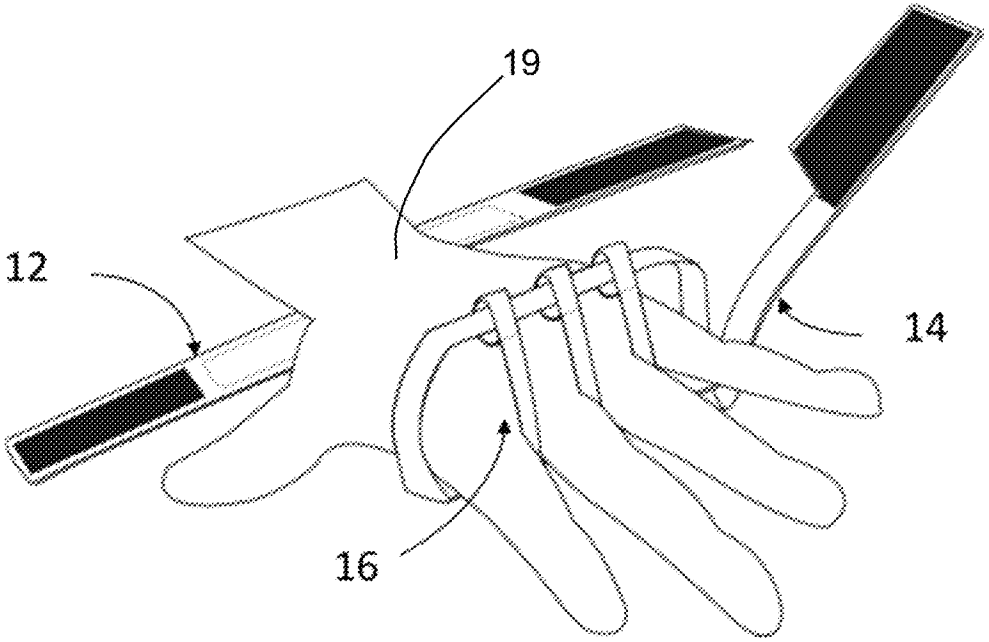
FIG. 13 shows a diagrammatic drawing, from below, of another embodiment of a protective sports accessory for protecting a hand of a user fitted on the hand of the user.

In FIGS. 13 and 14, reference numeral 90 generally indicates an embodiment of a protective sports accessory for protecting a hand of a user when forming a fist for striking. With reference to the preceding drawings, like reference numerals refer to like parts, unless otherwise specified.

The accessory 90 is similar to the accessory 10, but lacks the thumb strap 13.

The purpose of a hand wrap or a wrist wrap is to protect the hand and wrist against injuries induced by punching, particularly repetitive punching as may occur during training or during an extended combat or sparring session. The hand wrap protects against a number of different types of injuries that are familiar to most boxers and other combat sportsmen. For example, it can support the wrist joint to keep it aligned during impact. Properly used, a hand wrap can reduce the chance of a sprain or fracture. It can also reduce the likelihood of a fracture of one of the metacarpal bones which is known as a "boxer's fracture". The hand and wrist wraps are used to compress the bones and tissues in the hand to reduce the injuries mentioned above. The hand and wrist straps also serve to limit relative movement of the wrist and the hand during striking to provide stabilization. In some cases, they can also provide a user with confidence to strike with greater force.

A problem with conventional hand and wrist wraps is that they can take quite some time to wrap. It is usual that it can take up to 10 minutes to wrap the hands properly. This can be particularly inconvenient, for example, when a user simply wants to train or spar in a relatively short time.

The accessory 10, 90 provides a means whereby a user can achieve a significant level of protection to the hand and wrist without the need to spend time wrapping the hand and wrist. It is clear from the drawings that the user can simply insert his or her fingers through the openings and then fasten the straps. This would take less than half a minute per hand. It follows that users would be more likely to take steps to protect their hands and wrists during training, for example, when training on a heavy bag. It is unlikely that users, particularly recreational boxers and martial artists would take the time to use conventional strapping or wrapping before regular workouts such as sparring and bag work. It follows that the accessory 10 can play a significant role in the reduction of injuries to the hands and wrists as a result of training.

It is envisaged that embodiments of a protective sports accessory can include the knuckle strap 14 for strapping around the knuckles of the user and capable of being gripped with fingers doubled into a palm when forming a first. The knuckle strap 14 has an inner portion which is the intermediate grip portion 28 for extending across an inside of the hand and an outer portion which can comprise the components numbered 30 and 32 for extending across the back of the hand so that when the knuckle strap 14 is tightened, in the manner described above, the knuckle strap is capable of urging the knuckles together to provide the protective effect described above.

In mixed martial arts and a number of other styles of combat it is necessary to both strike and grapple. It can therefore be inconvenient to have any material covering the palm of the hand. As can be seen in the drawings, the accessory 10, 90, allows the palm of the hand to be free. For example, as can be seen in FIG. 7, the grip strap 14 is configured to extend over the knuckle and across a region in which the fingers meet the palm. Furthermore, of the thumb strap 13, only the thumb loop 15 extends across the front of the hand and across a region in which the thumb meets the palm.

The appended claims are to be considered as incorporated into the above description.

Throughout the specification, including the claims, where the context permits, the term "comprising" and variants thereof such as "comprise" or "comprises" are to be interpreted as including the stated integer or integers without necessarily excluding any other integers.

It is to be understood that the terminology employed above is for the purpose of description and should not be regarded as limiting. The described embodiments are intended to be illustrative of the invention, without limiting the scope thereof. The invention is capable of being practiced with various modifications and additions as will readily occur to those skilled in the art.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

Words indicating direction or orientation, such as "front", "rear", "back", etc., are used for convenience. The inventor(s) envisages that various embodiments can be used in a non-operative configuration, such as when presented for sale. Thus, such words are to be regarded as illustrative in nature, and not as restrictive.

The invention claimed is:

1. A protective sports accessory for protecting a hand of a user when striking, the protective sports accessory comprising:

a wrist wrap configured for strapping around a wrist of the user;

a finger grip configured for gripping with fingers when the hand is formed into a fist, in which the finger grip includes an elongated grip strap configured for wrapping about knuckles of the user and having an elongated intermediate grip portion configured for being gripped with fingers when forming the fist and retained at about a junction between the fingers and the palm, the grip strap including two end portions, the intermediate grip portion being interposed between the end portions, and in which a securing arrangement is arranged on each end portion so that the end portions can be secured to each other, the intermediate grip portion and the end portions being configured so that the end portions can be secured to each other over the knuckles;

a tensioning member that interconnects the wrist wrap and the intermediate grip portion, the wrist wrap, the intermediate grip portion and the tensioning member being configured for setting up tension in the tensioning member when the hand is formed into the fist; and a threading aperture included on one of the end portions so that the intermediate grip portion is threaded through the aperture to define a loop through which the fingers can extend.

2. The protective sports accessory as claimed in claim 1, in which the end portions are wider than the intermediate grip portion.

3. The protective sports accessory as claimed in claim 1, in which the grip portion is configured so that the grip portion can be doubled back, over the loop, to allow the end portions to be secured to each other over the knuckles.

4. The protective sports accessory as claimed in claim 3, in which the securing arrangement includes part of a fastener on an obverse surface of one of the end portions and a complementary part of the fastener on an obverse surface of the other of the end portions so that one of the end portions can overlie the other and both end portions can overlie the knuckles.

5. The protective sports accessory as claimed in claim 1, in which the tensioning member includes at least one tensioning strap that is connected, at one end, to the wrist wrap and, at an opposite end, to the intermediate portion, to extend across the loop so that, together with the intermediate portion, the loop is divided into at least two openings, each opening accommodating at least one finger.

6. The protective sports accessory as claimed in claim 5, in which the, or each, tensioning strap is configured to extend between one of the end portions that overlies the knuckles and the knuckles and between the fingers.

7. The protective sports accessory as claimed in claim 6, in which at least one sleeve is arranged on a reverse surface of the one of the end portions so that the, or each, tensioning strap is received through one respective sleeve and can slide relative to the sleeve to accommodate the setting up of tension in the, or each, tensioning strap when the fist is formed.

8. The protective sports accessory as claimed in claim 1, in which the, or each, tensioning strap has a loop at its end with the intermediate portion received through the loop, the loop being capable of sliding relative to the intermediate portion so that the openings can accommodate differently sized fingers.

9. The protective sports accessory as claimed in claim 5, in which the tensioning member includes three tensioning straps so that the loop is divided into four openings, one for each finger.

10. The protective sports accessory as claimed in claim 1, in which the wrist wrap includes elongated wrist strap portions that have a securing arrangement for wrapping around a wrist of the user and for securing the wrist strap in position when wrapped around the wrist of the user.

11. The protective sports accessory as claimed in claim 1, in which a thumb strap is connected to the wrist strap at one end and a thumb loop is arranged at an opposite end of the thumb strap, the thumb loop being configured to receive a thumb of the user and the thumb strap being configured to extend over the back of the hand and configured so that a tension is set up in the thumb strap when the fist is formed for striking.

12. A protective sports accessory for protecting a hand and wrist of a user when punching comprises:

a wrist strap for strapping around a wrist of the user;

a knuckle strap for strapping around knuckles of the user and capable of being gripped with fingers doubled into a palm when forming a fist, the knuckle strap having an intermediate grip portion that can extend across an inside of the hand so that, when tightened, the knuckle strap is capable of urging the knuckles together, the knuckle strap including two end portions, the intermediate grip portion being interposed between the end portions, and in which a securing arrangement is arranged on each end portion so that the end portions can be secured to each other, the intermediate grip portion and the end portions being configured so that the end portions can be secured to each other over the knuckles;

a threading aperture included on one of the end portions so that the intermediate grip portion is threaded through the aperture to define a loop through which the fingers can extend; and a number of tensioning straps that interconnect the wrist strap and the intermediate grip portion to define, together with the knuckle strap, openings through which fingers can be received.

13. The protective sports accessory as claimed in claim 12 in which the tensioning straps are arranged on the knuckle strap in an adjustable manner so that a size of the openings adjust to suit the user when fingers are inserted through the openings.

* * * * *